United States Patent [19]

Amano et al.

[11] Patent Number: 4,519,873

[45] Date of Patent: May 28, 1985

[54] PROCESS FOR PRODUCING FIBROUS SHEET

[75] Inventors: Masahiro Amano; Shunji Seino; Ryota Nishiyama; Masaoki Nozaki, all of Tokyo, Japan

[73] Assignee: Mitsubishi Paper Mills, Ltd., Tokyo, Japan

[21] Appl. No.: 465,191

[22] Filed: Feb. 9, 1983

Related U.S. Application Data

[63] Continuation of Ser. No. 6,646, Jan. 26, 1979, abandoned.

[30] Foreign Application Priority Data

Feb. 9, 1978 [JP] Japan ..... 53-13873

[51] Int. Cl.[3] ..... D21H 5/12

[52] U.S. Cl. ..... 162/138; 162/146; 162/157.3; 162/205

[58] Field of Search ..... 162/146, 138, 205, 206, 162/157.3; 428/280

[56] References Cited

U.S. PATENT DOCUMENTS

| | | | |
|---|---|---|---|
| 3,532,800 | 10/1970 | Wyly et al. | 162/138 |
| 3,756,908 | 9/1973 | Gross | 162/157.3 |
| 4,091,058 | 5/1978 | Sander et al. | 162/157.3 |

FOREIGN PATENT DOCUMENTS

| | | | |
|---|---|---|---|
| 2302379 | 9/1976 | France | 162/157.3 |

OTHER PUBLICATIONS

Tappi, "Freeness Scale Interconversion", (1945).

*Primary Examiner*—Peter Chin

*Attorney, Agent, or Firm*—Cushman, Darby & Cushman

[57] ABSTRACT

A heat resistant thin paper excellent in electrical insulating property can be obtained by subjecting pulp-like particles of aromatic polyamide or aromatic polyamide-imide, which have a low freeness and a low ion content to wet paper-making process, drying and then making the resulting web dense under a pressure.

11 Claims, No Drawings

PROCESS FOR PRODUCING FIBROUS SHEET

CROSS REFERENCE TO RELATED APPLICATIONS

This application is a continuation of our earlier application Ser. No. 6,646 filed Jan. 26, 1979, now abandoned.

This invention relates to an electrical insulating thin paper excellent in heat resistance.

It is the demand of the times to make electrical instruments smaller in size, lighter in weight and more flame-retardent. As its result, an electrical insulating material excellent in heat resistance has been requested. Owing to its high heat resistance and excellent electrical characteristics, aromatic polyamide is recognized as a material most suitable for such uses, and a sheet incorporating the polymer is actually in use.

All these types of sheets are produced by mixing in water short fibers of aromatic polyamide with pulp-like particles of aromatic polyamide resembling wood pulp in shape to give a slurry, making the slurry into web by means of an ordinary paper-making machine, and pressing the resulting web at a high temperature by means of a hot calender or the like to make it dense. However, the sheet thus obtained has many voids in its structure so that it is poor in dielectric breakdown strength. Moveover it is difficult to make this type of sheet into an extremely thin paper having a thickness of, for example, 50 μm or less because the reliability of insulation may be impaired. Further, this type of sheets are sometimes unsatisfactory in respect of electroconductive characteristics. In making the size of electrical instrument smaller, it is necessary to develope such a thin paper having a high heat resistance and high dielectric breakdown voltage, such a paper, if developed, will exhibit most desirable performance as electrical insulating material in addition to achieving a desirable space factor.

The present inventors have earnestly studied at the aim of overcoming the above-mentioned difficulties to discover that such a thin paper as of 8–100 μm having a high breakdown voltage can be obtained with a high efficiency by making pulp-like particles of an aromatic polymer having a specified freeness into paper by means of a paper-making machine, followed by making it dense by means of roll nip. This invention has been accomplished based on this discovery.

Thus, this invention provides an electrical insulating thin paper characterized in that it is obtained by washing pulp-like particles of an aromatic polymer having a freeness of 80 ml or less as expressed by Canadian Standard Freeness (hereinafter abbreviated to CSF), dispersing the particles preferably into deionized water to give an aqueous slurry, making the slurry into web, drying and then passing the paper through a roll nip constituted of fiber-filled and chilled iron roll to densify it.

The aromatic polymer herein referred to includes aromatic polyamides and aromatic polyamide-imides, of which examples are shown below:

(1) Aromatic Polyamides

These include those polyamides of which main chain is constituted of the recurring unit represented by the following formula (I) or (II):

$$-NH-Ar_1-NH-CO-Ar_2-CO- \quad (I)$$

$$-NH-Ar_3-CO- \quad (II)$$

wherein $Ar_1$, $Ar_2$ and $Ar_3$ are divalent aromatic groups which may be the same or different one another.

Typical examples of this type of aromatic polyamides include poly-(m-phenylene isophthalamide), poly-(m-phenylene terephthalamide), poly-(p-phenylene terephthalamide), poly-(p-phenylene isophthalamide), poly-(4,4'-oxydiphenylene isophthalamide), poly-(4,4'-oxydiphenylene terephthalamide), poly-(m-benzamide), poly-(p-benzamide) and the like. Their copolymers may be included. Those containing a small quantity of constituents other than aromatic groups, such as piperazine, cyclohexanedicarboxylic acid or the like, may also be included.

(2) Aromatic Polyamide-imides

These include the polyamide-imides having the recurring units represented by the following formula:

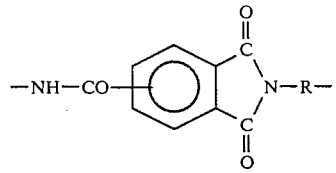

wherein R is

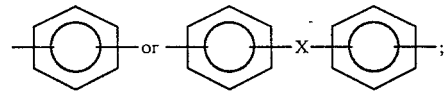

and X is —O—, —$SO_2$—,

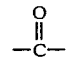

or lower alkylene group.

The term "pulp-like particle" used in this invention means a particle having many protrusions, having a fiber-like, thin film-like or ribbon-like structure and capable of forming a paper-like structure when treated with a paper-making machine. It can be obtained by contacting a solution of an aromatic polymer under a high shearing force with a precipitating agent which is miscible with the solvent used for the polymer and acts as a nonsolvent for the polymer, and thereby precipitating the polymer in the form of pulp like particles. An example of the production process is mentioned in U.S. Pat. No. 2,988,782, though this invention is not limited to it. In the process mentioned above, freeness of pulp-like particle can be regulated by varying the shape of pulp-like particle as mentioned later, as well as by varying concentration (viscosity) of the polymer solution used for producing the particle and shearing speed at the time of mixing the solution with a precipitating agent.

As a general tendency, freeness of the pulp-like particle obtained decreases when polymer concentration is lowered or shearing speed is increased. In the case of the pulp-like particle having a freeness (CSF) of 80 ml or less used in this invention, the concentration of the polymer solution is 25% or less and preferably in the range of 5–20%. When the polymer solution used has a relatively high value of concentration in the range specified above, one may adopt a relatively high shearing speed appropriately. When the polymer solution used has a relatively low concentration in the range, one may adopt a relatively low shearing speed appropriately. The precipitant may be water alone, glycerin, ethylene glycol, polyethylene glycol, glycerin-water mixture, water-organic solvent mixture, ether or the like. Alternatively, it may also be an aqueous solution containing one or more kind of salt represented by a formula $MX_n$. Alternatively, one may arbitrarily select the precipitant from mixtures generally represented by a system solvent-water-$MX_n$, wherein M is Li, Na, K, Mg, Ca, Sr, Ba, Zn, Al or Ni; X is Cl, Br, $NO_3$ or $CH_3COO.SCN$; and n is an integer of 1–4.

Preferably the particle has a fiber-like, ribbon-like or thin film-like shapes because such shapes facilitate a close junction of the particles. Thick rod-like shape and powdery shape are not preferable.

Freeness of the pulp-like particle is dependent not only on the above-mentioned shape but also intimately on water retention characteristics and dimension of the particle. The term "water retention" herein used means the quantity of water retained in the wet mat which has been made from aqueous slurry and then dehydrated by centrifugation. As a general tendency, a reduction in freeness is accompanied by an increase in water retention. Though pulp-like particle is soft and so complicated in shape that its dimension is difficult to measure, there is a tendency that freeness is lower in more minute particles.

A lower freeness of pulp-like particle gives higher values of tensile strength, elongation and dielectric breakdown voltage of the sheet obtained therefrom. If freeness becomes less than about 100 ml, the changes in tensile strength and elongation are not significant. It has been found that dielectric breakdown voltage becomes higher with reduction of freeness and particularly in the case of thin paper, and a marked increase in dielectric breakdown voltage is observed at a CSF value of 80 ml or less.

Pulp-like particles increase their water retention with reduction of freeness. When CSF is less than 80 ml, a wet mat which has been prepared by dehydrating 1 g of the particle for 5 minutes under a centrifugal force of 3000 G has a water retaining ability of 3 g or more. So thin a paper as to have a basis weight of 8 g/m$^2$ can be made by means of a paper-making machine only by using pulp-like particles having a CSF value of 80 ml or less. The term "thin paper" herein referred to means a paper obtainable by making a paper dense. Though its thickness is not particularly specified, it should be usually in the range of 8–100 $\mu$m if performances and uses are taken into consideration.

According to another preferable embodiment of this invention, the content of metallic ions, particularly of monovalent metallic ions such as $Na^+$ or $K^+$, in the sheet produced from the above-mentioned pulp-like particle is lowered. This is important to an insulating material, because insulation resistance greatly varies depending on the content of metallic ions particularly at high temperatures where ionic conduction becomes predominant. In the region that the content of $Na^+$ and $K^+$ is less than 300 ppm, insulation resistance increases exponentially with decrease of ion content. The ion content is preferably kept at a value less than 100 ppm, and paticularly less than 60 ppm. For this reason, the electroconductive characteristics of sheet can be maintained in the desirable range by thoroughly washing the pulp-like particle with water, making the washed particles an aqueous slurry by the use of deionized water and then producing a paper from it. Though it is possible to also use deionized water for washing pulp-like particle in order to additionally lower the content of metallic ions, the use of deionized water only in the paper-making step is enough for the purpose of this invention and the washing of pulp-like particle may be carried out with industrial water, because the washing effect is particularly effectively achieved in the paper-making step where the particle is treated in the form of a dilute slurry. However, the embodiments of this invention include arbitrary electroconductive characteristics as optional items, so that one may appropriately select and combine various grades of waters such as distilled water, deionized water and industrial water for washing pulp-like particle and for making paper therefrom so as to realize the intended electroconductive characteristics.

Next, one presses the sheet by means of a nip of chilled rolls and elastic rolls, such as supercalender, to make the sheet dense, and then one can obtain a thin paper having a breakdown voltage close to that of the film of the polymer and having excellent electroconductive characteristics. Though the rolls for this step may be used at ordinary temperature, a greater effect can be obtained at elevated temperatures and a temperature of about 70°–90° C. is fit for the purpose. The use of an elastic roll having a relatively higher hardness is more preferable, and the use of asbestos-filled roll is more effective than that of cotton-filled roll for this purpose.

According to the observation by electron microscope, the section of thin paper thus densified is so constructed that the shape of individual pulp-like particles cannot be discriminated but the particles are closely welded to one another.

By the procedure mentioned above, there is obtained a thin paper which is excellent in heat resistance, has so high in dielectric breakdown voltage that alternate current dielectric breakdown strength is 60 KW/mm or above when measured with 25$\phi$ cylindrical electrode, and is excellent in electroconductive characteristics enough to meet the demand.

Referring to the following concrete Examples and comparative Examples, this invention will be illustrated in more detail. The embodiment of this invention is not limited to these examples but skilled in the art may embody this invention in various manners without deparating from the sprit and scope of the claims of this application.

In the Examples and comparative Examples, water retention (%) of the pulp-like particles used is calculated from a precipitate of the pulp-like particles which has been obtained by centrifugating an aqueous slurry containing a known weight of the particles for five minutes under 3,000 G.

Dielectric breakdown strength of paper produced is measured with 25$\phi$ cylindrical electrode (in air).

Tensile strength and elongation of paper produced is measured by a normal tensile testing machine, and their value is expressed by 'MD' in the direction longitudinal to the paper flow and by 'CD' in the direction perpendicular to the paper flow, respectively.

EXAMPLES 1-3

Polymer solutions in which the concentration of polymer ranging from 15% to 8% were obtained by dissolving a poly-(m-phenylene isophthalamide) having an inherent viscosity of 1.6 as measured in concentrated sulfuric acid at 30° C. in dimethylacetamide (hereinafter referred to as DMAc) containing 5% of lithium chloride. A precipitant solution consisting of 40% of DMAc, 25% of calcium chloride and 35% of water was prepared. 1 Part by weight of the polymer solution was contacted with 30 parts by weight of the precipitant solution in a homomixer with stirring at a high speed to give pulp-like particles. The particles were thoroughly washed with water and then dispersed in deionized water to give an aqueous slurry having a concentration of 0.21%, from which a thin paper having a basis weight of 26 g/m$^2$ was made on a fourdrinier machine.

Subsequently, the thin paper was densified by passing it through 8 nips by means of a supercalender constituted of asbestos-filled rolls and chilled iron rolls at a roll surface temperature of 80° C. and under a linear pressure of 200 kg/cm. Then the properties of the thin paper obtained were measured. The results were as shown in Table 1.

TABLE 1

| | Polymer concentration (%) | Freeness (ml) | Water retention (%) | Tensile strength (g/mm$^2$) | Elongation (%) | Dielectric breakdown strength (KV/mm) |
|---|---|---|---|---|---|---|
| Example 1 | 8 | 12 | 633 | MD 6.2<br>CD 4.5 | MD 14.9<br>CD 10.8 | 103.6 |
| Example 2 | 10 | 42 | 470 | MD 5.1<br>CD 3.3 | MD 15.4<br>CD 10.5 | 77.7 |
| Example 3 | 15 | 78 | 414 | MD 4.6<br>CD 3.0 | MD 12.3<br>CD 9.6 | 62.0 |
| Comparative Example 1 | 25 | 110 | 354 | MD 3.8<br>CD 2.6 | MD 10.6<br>CD 9.2 | 50.3 |
| Comparative Example 2 | 30 | 250 | 260 | MD 3.5<br>CD 2.3 | MD 7.5<br>CD 4.2 | 41.5 |

EXAMPLES 4-5

A polymer solution having a concentration of 10% was prepared by dissolving a poly-(m/p-phenylene isophthalamide) (m/p=7/3) having an inherent viscosity of 1.5 as measured in concentrated sulfuric acid at 30° C. in DMAc containing 5% of lithium chloride, from which pulp-like particle was prepared in the same manner as in Examples 1-3. The pulp-like particle thus obtained had a freeness of 42 ml and a water retention of 420%. The pulp-like particle was washed with industrial water or deionized water, after which it was dispersed into deionized water to give a 0.23% slurry. It was made into a thin paper having a basis weight of 30 g/m$^2$ on a fourdrinier machine and then densified by means of a supercalender at a roll temperature of 88° C. under a pressure of 180 kg/cm to give a thin paper of 30 μm.

As a comparative example, the pulp-like particle was made into a slurry by the use of industrial water from which a thin paper was prepared in the same manner as above. Although the results of the example were comparable to those of the comparative example in tensile strength, elongation and dielectric breakdown voltage, there was observed a difference between them in electroconductivity. The results are summarized in Table 2.

TABLE 2

| | Metallic ion content (ppm) | | Volume resistivity at 152° C. |
|---|---|---|---|
| | $Na^+$ | $K^+$ | (Ω-cm) |
| Example 4 | 25 | 8 | $1.0 \times 10^{16}$ |
| Example 5 | 56 | 8 | $1.6 \times 10^{15}$ |
| Comparative Example 3 | 130 | 12 | $4.8 \times 10^{14}$ |

EXAMPLE 6

Trimellitic anhydride and 4,4'-diaminodiphenylmethane were reacted at a molar ratio of 2:1 and then dehydrated. To the reaction product were added trimellitic anhydride and 4,4'-diphenylmethane diisocyanate at a molar ratio of 2:3 to give a polyamide-imide having an inherent viscosity of 0.5 in N-methyl-2-pyrrolidone. The polyamide-imide was dissolved at 30° C. in N-methyl-2-pyrrolidone to give a polymer solution having a concentration of 8%. A precipitant solution consisting of 50 parts of glycerin and 50 parts of water was prepared, of which 30 parts was contacted with 1 part of the polymer solution in a homomixer with stirring at a high speed to give pulp-like particle. The pulp-like particle thus obtained had a freeness of 30 ml and a water retention of 520%. It was thoroughly washed with water and then dispersed into deionized water to give a 0.2% slurry, from which a paper having a basis weight of 32 g/m$^2$ was formed as hand sheet. Then it was densified in the same manner as in Example 4-5 to give a thin paper of 30 μm. Measurements revealed that it had a tensile strength of 4.0 kg/mm$^2$, an elongation of 10.8% and an dielectric breakdown strength of 79.5 KV/mm.

What is claimed is:

1. A process for producing an electrical insulating thin paper consisting essentially of pulp-like particles of an aromatic polyamide or an aromatic polyamide-imide, said process comprising the steps of:

(1) forming a web from an aqueous slurry of pulp-like particles of an aromatic polyamide or an aromatic polyamide-imide prepared by precipitating the polyamide or polyamide-imide from a solution thereof in a concentration of at most 20% in a single solvent therefore, said particles having a freeness of 80 ml or less as expressed by Canadian Standard Freeness, (2) drying the said web, and then (3) pressing said web thereby densifying same to make the web's dielectric breakdown strength at least 60 KV/mm.

2. The process according to claim 1 wherein the web is pressed by passing same through a nip between elastic rolls and chilled rolls.

3. The process according to claim 1 in which prior to step (1) said pulp-like particles have been washed with deionized water.

4. The process according to claim 1 in which the slurry of the said pulp-like particles in step (1) is composed of the pulp-like particles and deionized water.

5. The process according to claim 1 in which the thin paper has a thickness of about 8 to about 100 μm.

6. The process according to claim 1 in which the insulating thin paper has a dielectric breakdown strength of at least 62.0 KV/mm.

7. The process according to claim 6 in which the dielectric strength is at least 77.7 KV/mm.

8. The process according to claim 7 in which the dielectric strength is at least 79.5 KV/mm.

9. The process according to claim 8 in which the dielectric strength is at least 103.6 KV/mm.

10. The process according to claim 5 in which the insulating thin paper has a dielectric breakdown strength in the range of about 77.7 to about 103.6 KV/mm.

11. The electrical insulating thin paper produced by the process of claim 1.

* * * * *